US011022323B2

(12) United States Patent
Mushnick

(10) Patent No.: US 11,022,323 B2
(45) Date of Patent: Jun. 1, 2021

(54) ADJUSTABLE HEAT REFLECTOR

(71) Applicant: Steve Mushnick, Mission Viejo, CA (US)

(72) Inventor: Steve Mushnick, Mission Viejo, CA (US)

(73) Assignee: Steve Mushnick, Mission Viejo, CA (US)

( * ) Notice: Subject to any disclaimer, the term of this patent is extended or adjusted under 35 U.S.C. 154(b) by 0 days.

(21) Appl. No.: 15/284,875

(22) Filed: Oct. 4, 2016

(65) Prior Publication Data

US 2017/0102151 A1 Apr. 13, 2017

Related U.S. Application Data

(63) Continuation of application No. 29/541,876, filed on Oct. 8, 2015.

(60) Provisional application No. 62/239,111, filed on Oct. 8, 2015.

(51) Int. Cl.
*F24C 3/04* (2006.01)
*F24C 15/22* (2006.01)

(52) U.S. Cl.
CPC ..... *F24C 15/22* (2013.01); *F24D 2220/06* (2013.01)

(58) Field of Classification Search
CPC .... F24C 15/22; F24C 1/10; F24C 1/12; F24C 7/065; F24B 1/1957; F24J 2/10; F24D 19/062
USPC ..... 126/40, 92 B, 83, 259 R, 552; 392/376
See application file for complete search history.

(56) References Cited

U.S. PATENT DOCUMENTS

| | | | | |
|---|---|---|---|---|
| D18,896 | S | 2/1889 | Oalely | |
| 2,128,470 | A * | 8/1938 | Phillips | F21V 7/0025 362/282 |
| 2,715,675 | A * | 8/1955 | Macksoud | A61N 5/06 313/26 |
| 2,821,154 | A * | 1/1958 | Tennison, Jr. | E04D 13/068 405/122 |
| 3,379,481 | A | 4/1968 | Fisher | |
| 3,394,697 | A | 7/1968 | Lewis | |

(Continued)

FOREIGN PATENT DOCUMENTS

| | | |
|---|---|---|
| DE | 2021096 A1 | 4/1970 |
| DE | 29818626 | 10/1998 |

(Continued)

OTHER PUBLICATIONS

"CEN Racing 4×56 Threaded Hinge Pins (GS025)." Www.rchobbyexplosion.com, www.rchobbyexplosion.com/CEN_Racing_4×56_Threaded_Hinge_Pins_p/ceggs025.htm?gclid=EAlalQobChMI3KiWmbnp2Q1VQksNCh091QFeEAQYAyABEgJVFvD_BwE&gdffi=1 2fdf7af50b140e3ab6cbc5165a5719e&gdfms=8E8E8C12E7B94EEB8D4B9E80BCB7EC96.*

(Continued)

*Primary Examiner* — Steven B McAllister
*Assistant Examiner* — John E Bargero
(74) *Attorney, Agent, or Firm* — Fish IP Law, LLP

(57) ABSTRACT

Devices and methods for reflecting at least a portion of the heat output of a space heater are described. A supplementary reflector is positioned to reflect a portion of the heat generated by the space heater. The supplementary reflector can be angled relative to the vertical axis to direct reflected heat downwards, while also providing adjustable side panels that provide focus and further direction of the reflected heat.

6 Claims, 4 Drawing Sheets

(56) References Cited

U.S. PATENT DOCUMENTS

| | | | | |
|---|---|---|---|---|
| 3,952,722 | A * | 4/1976 | Yamagishi | F24B 1/1957 126/553 |
| 4,391,323 | A * | 7/1983 | Schnier | F24D 5/08 165/183 |
| 4,543,021 | A | 9/1985 | Adler | |
| D286,322 | S | 10/1986 | Cataniam | |
| D299,601 | S | 1/1989 | Campbell | |
| D325,035 | S | 3/1992 | Sparks | |
| D352,140 | S | 11/1994 | Easton | |
| 5,664,556 | A * | 9/1997 | Byers | F24B 1/1957 126/500 |
| D389,270 | S | 1/1998 | Malmsten | |
| D416,322 | S | 11/1999 | Suher | |
| 6,102,031 | A * | 8/2000 | Waters | F24C 1/12 126/92 AC |
| 6,206,551 | B1 * | 3/2001 | Stubblefield, Jr. | F21L 19/00 362/283 |
| 6,651,647 | B2 | 11/2003 | Waters | |
| 6,745,759 | B2 * | 6/2004 | Bossier | F24C 1/10 126/92 AC |
| 6,860,625 | B2 * | 3/2005 | Bronchak | B63B 45/02 362/159 |
| D542,404 | S | 5/2007 | Boyette | |
| D557,867 | S | 12/2007 | Northrop | |
| D559,375 | S | 1/2008 | Rumens | |
| D587,799 | S | 3/2009 | Oleson | |
| D626,769 | S | 11/2010 | Rogers | |
| D642,256 | S | 6/2011 | Byers | |
| D644,456 | S | 9/2011 | Martin | |
| 8,047,197 | B1 * | 11/2011 | Zernich | F24C 15/22 126/83 |
| 8,573,965 | B2 | 11/2013 | Hendershot | |
| D720,505 | S | 12/2014 | Kersten | |
| 9,045,214 | B2 | 6/2015 | Koch | |
| 2008/0078377 | A1 | 4/2008 | Gardner | |
| 2010/0132698 | A1 | 6/2010 | Pedersen | |
| 2010/0146734 | A1 * | 6/2010 | Munson | E05D 5/12 16/334 |
| 2011/0073095 | A1 | 3/2011 | Bechtold | |
| 2013/0167835 | A1 * | 7/2013 | Zhu | F23D 14/12 126/92 B |
| 2017/0102151 | A1 | 4/2017 | Mushnick | |

FOREIGN PATENT DOCUMENTS

| | | |
|---|---|---|
| DE | 102006026984 | 12/2007 |
| EP | 1310738 A1 | 5/2003 |
| TR | 200101671 | 10/2001 |
| WO | 2013140352 | 9/2013 |

OTHER PUBLICATIONS 27 inch W Reflector, image post date 2011, site visited Aug. 30, 2017, (online), <http://www.plowhearth.com/27w-reflector.htm>.

36 inch W Reflector, image post date 2012, site visited Aug. 30, 2017, (online), <http://www.plowhearth.com/36w-reflector.htm>.

Fold Traditional Brushed Stainless Steel Fireback, image post date Nov. 20 2014, site visited Aug. 30, 2017, (online), w <https://web.archive.org/web/20141120160348/https://shop. fireplacesplus.com/3_Fold_ Traditional_Brushed_Stainless_ Steel_Firebac_p/fbs-18-fslash-24-fslash-30-fslash-36.htm>.

* cited by examiner

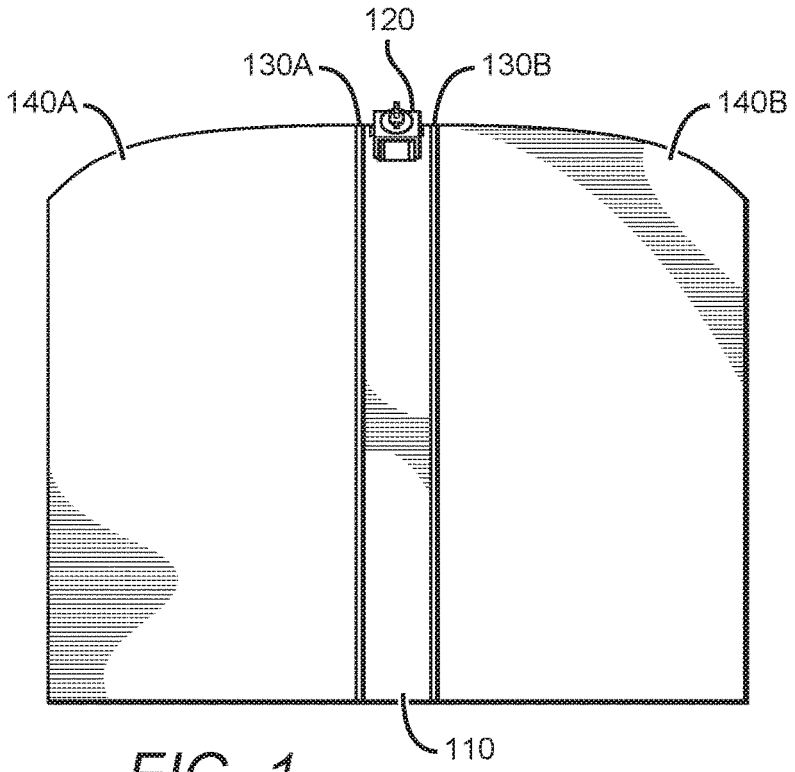
FIG. 1
FIG. 2
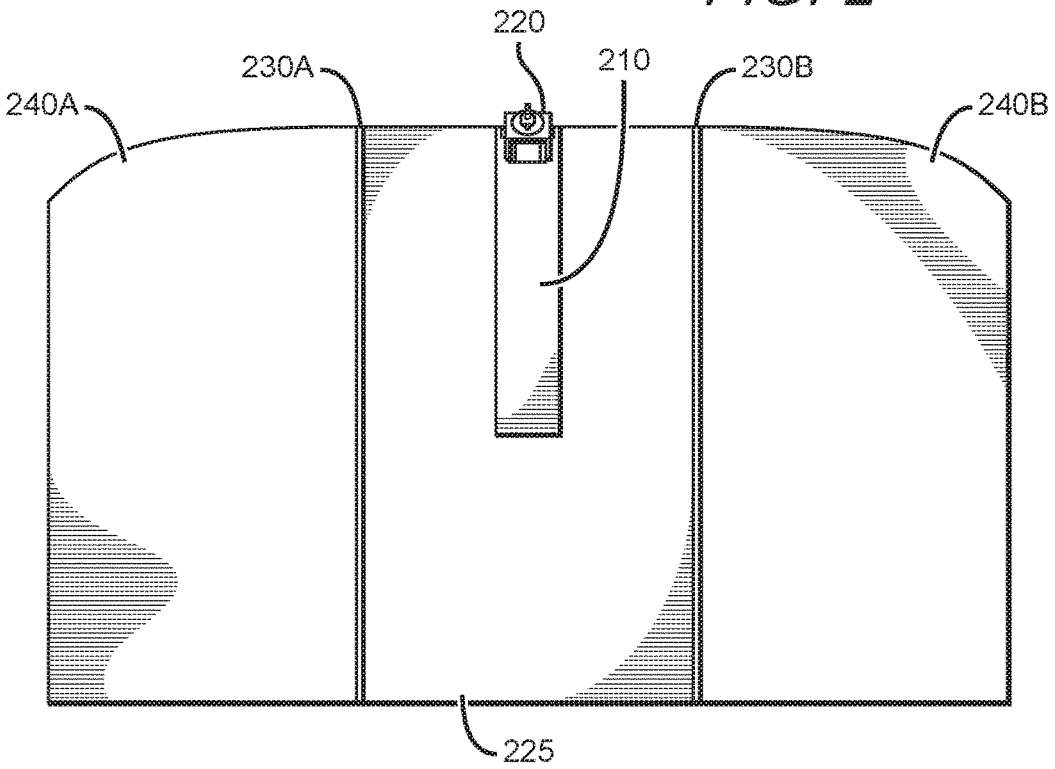

FIG. 7A
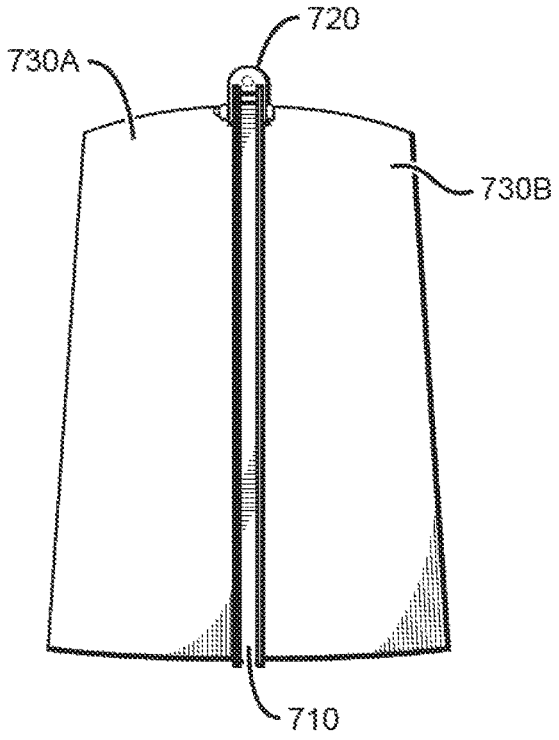
FIG. 7B
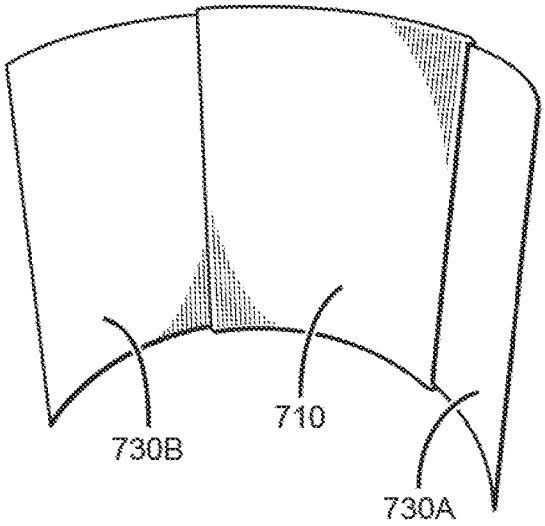
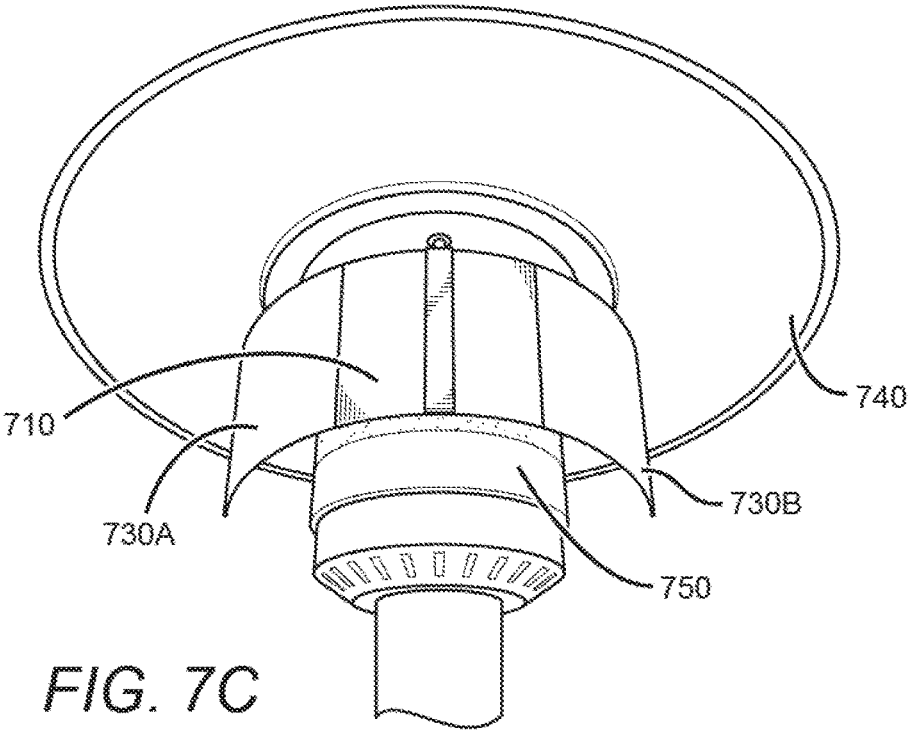
FIG. 7C

ADJUSTABLE HEAT REFLECTOR

This application claims the benefit of U.S. Design patent application Ser. No. 29/541,876, filed Oct. 8, 2015, and U.S. Provisional Patent Application No. 62/239,111, filed on Oct. 8, 2015. These and all other referenced extrinsic materials are incorporated herein by reference in their entirety. Where a definition or use of a term in a reference that is incorporated by reference is inconsistent or contrary to the definition of that term provided herein, the definition of that term provided herein is deemed to be controlling.

FIELD OF THE INVENTION

The field of the invention is space heaters, particularly heat reflectors intended for use with space heaters.

BACKGROUND

The background description includes information that may be useful in understanding the present invention. It is not an admission that any of the information provided herein is prior art or relevant to the presently claimed invention, or that any publication specifically or implicitly referenced is prior art.

Space heaters are common fixtures in outdoor settings, such as outdoor dining areas and patios, and serve to provide heat to such areas in cold and cool weather. Such space heaters typically generate heat by combustion of flammable gases, such as propane, butane, or natural gas, which are often provided in pressurized vessels. A feed line connects such fuels to a burner assembly that provides heat. Electrically powered space heaters that use resistive elements to generate heat are also known.

In order to spread the generated heat over a broad area, space heaters generally elevate the heat producing portion (for example, the burner) so that heat and infrared radiation produced can cover a greater area. Such heat and infrared radiation radiates outwards in all directions from the heating element. As a result, a great deal of heat energy is directed upwards or away from the occupied area, and is therefore wasted. This waste of heat energy directly impacts the efficiency of the heater, and results in ineffective heating of the open space and increased fuel consumption.

Many space heaters, for example the common "umbrella" style space heater attempt to address this problem by including a heat reflector. In umbrella style space heaters the heat reflector is a downwards-facing parabolic metal reflector that is positioned directly over the heating element, and has a concave lower surface. Such a heat reflector reflects a portion of the heat energy produced downwards to define a "comfort zone" distributed around the heater that is maintained at a comfortably elevated temperature relative to the surroundings. However, such a heat reflector only directs the reflected heat downwards and radially. As a result, a great deal of the heat energy produced is directed away from the occupants of the open space and remains wasted.

Attempts have been made to further direct the heat produced by space heaters. For example, Eco-Dome® produces a curved metal sheet that mount beneath the circular heat reflector of an umbrella style space heater and reflects heat horizontally. All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply. A similar approach is described in United States Patent Application Publication No. 2010/0,132,698 (to Pederson and Weng). U.S. Pat. No. 8,047,197 (to Zernich), and European Patent Application Publication No. EP 1310738 (to Cristini and Cristini). A similar approach, using a multi-lobed reflector that is attached to the edge of a patio heater's parabolic reflector is discussed in United States Patent Application Publication No. US2011/0,073,095 (to Bechtold). While such devices can reflect at least a some of the heat energy that would otherwise be wasted towards the occupants of the open space, the design and position of such devices directs much of the reflected heat energy in a horizontal plane at the height of the heating element (which is, by design, above that of a seated individual).

Similarly, devices that permit tilting of the parabolic reflector of an umbrella style space heater have been proposed, for example as shown in United States Patent Application Publication No. 2013/0,167,835, to Zhu. Such tilting circular reflectors, however, are inefficient at directing reflected heat laterally, and necessarily direct a significant portion of the directed heat upwards and away from the occupants of the open space.

Another approach is described in German Patent Application No. 2021096U1 (to Polzer et al), which replaces the curved wall of the parabolic reflector of such a space heater with a series of discs. With one exception each of these discs is linked to the disc on each side, so that that they form a continuous chain with a single gap. The degree of overlap between the discs can be adjusted, essentially providing an overhead parabolic reflector with an adjustable gap. While this design permits a certain degree of control over the direction in which heat is dispersed considerable heat is still directed upwards and away from the desired comfort zone.

Yet another approach is described in U.S. Pat. No. 6,651,647 (to Waters), which places a pair of vertically projecting baffles within the parabolic reflector of a space heater. The baffles reflect heat horizontally, and the angle between them can be adjusted to control the size of the comfort zone produced. Such a design, however, necessarily project heat at approximately the height of the parabolic reflector, which is above that of a seated user.

Thus, there is still a need for heat reflector suitable for use with a space heater that provides efficient direction of radiated heat energy towards as desired outside space.

SUMMARY OF THE INVENTION

The inventive subject matter provides devices and methods for reflection and/or redirection of heat produced by a space heater.

One embodiment of the inventive concept is an adjustable supplementary heat reflector that includes a central support. Such a central support has a mount, a first edge, and a second edge that opposes the first edge. The mount is configured to attach to a primary reflector of a space heater and to provide movement of the central support along a first axis of rotation relative to the major axis of the space heater (which can be vertical). Such a supplementary heat reflector includes a first heat reflecting panel that is attached to an edge of the central support by a pivoting mechanism (such as a piano hinge), where the first pivoting mechanism is configured to provide movement of the first heat reflecting panel along a second axis of rotation that is normal to the first axis of rotation. The supplementary heat reflector can include a second heat reflecting panel coupled to a different edge of the central support by another pivoting mechanism (such as a piano hinge) where the second pivoting mechanism is configured to provide movement of the second heat reflecting panel along the second axis of rotation. In some embodiments the adjustable secondary heat reflector also includes a central heat reflector, where the first pivoting mechanism and the second pivoting mechanism are coupled to opposing edges of the central heat reflector. In other embodiments the mount can include a tensioning mechanism, configured to apply a tensioning force to the mount so as to provide resistance to movement through the first axis of rotation. In some embodiments the adjustable secondary heat reflector the pivoting mechanism includes a tensioning mechanism that applies a tensioning force to the pivoting mechanism so as to resist rotation through the second axis of rotation. Such a tensioning mechanism can include a pin that is part of the pivoting mechanism and has a threaded portion, which can be used in conjunction with a threaded cap or sleeve that has a complementary thread.

Another embodiment of the inventive concept is an adjustable supplementary heat reflector that includes a mount, where the mount is configured to attach to a primary reflector of a space heater. Such a mount can include a pivoting mechanism that provides a vertical axis of rotation relative to the space heater. The supplementary heat reflector includes a curved (for example, arcuate) heat reflecting panel coupled that is also attached to the mount (and hence the pivoting mechanism). Such a supplementary heat reflector can include an additional curved heat reflecting panel, where the additional curved heat reflecting panel is attached to the first curved heat reflecting panel by a sliding mechanism. In some embodiments the adjustable supplementary heat reflector includes a third curved heat reflecting panel, where the third curved heat reflecting panel is attached to the first curved heat reflecting panel by a sliding mechanism. These additional curved heat reflecting panels can have a shape and a radius of curvature that is essentially identical or at least similar to that of the curved heat reflecting panel bearing the mount. Such a sliding mechanism can include a rail and/or channel (which can be continuous or discontinuous) that is attached to or at least partially integrated into the first curved heat reflecting panel.

15. The adjustable secondary heat reflector of claim 9, wherein the second curved heat reflecting panel has an arcuate shape that has a radius of curvature that is essentially identical to that of the first curved heat reflecting panel.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

FIG. 1 depicts an embodiment of the inventive concept having a central support that is attached to two lateral heat reflecting panels.

FIG. 2 depicts an embodiment of the inventive concept having a central support that is attached to a central heat reflecting panel, which is in turn attached to two lateral heat reflecting panels.

FIG. 4A shows the heat reflector in a near-horizontal position. FIG. 4B shows the heat reflector at an approximately 45° angle. FIG. 4C shows the heat reflector in an essentially vertical position.

FIG. 5A shows the lateral heat reflecting panels and a central heat reflecting panel arranged in an essentially linear fashion. FIG. 5B shows the lateral heat reflecting panels arranged at slight angles relative to a central heat reflecting panel. FIG. 5C shows the lateral heat reflecting panels at an approximately 450 angle relative to a central heat reflecting panel. Such positions can be utilized in concert with the different angles depicted in FIG. 4.

FIGS. 7A, 7B, and 7C depict a curved heat reflector having a curved central heat reflecting panel and curved lateral heat reflecting panels that extend from the central heat reflecting panel. FIG. 7A shows a rear view of such a heat reflector with the curved lateral heat reflectors in a closed or non-extended position. FIG. 7B3 shows a front view of such a heat reflector with the curved lateral heat reflectors partially extended. FIG. 7C shows such a heat reflector mounted in a space heater with the curved lateral heat reflectors fully extended.

DETAILED DESCRIPTION

Figure 4A:
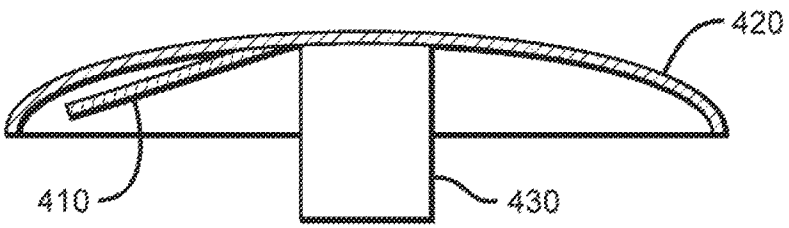
FIGS. 4A, 4B, and 4C depict a heat reflector of the inventive concept mounted at different angles relative to vertical within a space heater.

The following description includes information that may be useful in understanding the present invention. It is not an admission that any of the information provided herein is prior art or relevant to the presently claimed invention, or that any publication specifically or implicitly referenced is prior art. The following discussion also provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

The inventive subject matter provides a supplementary and/or secondary heat reflecting apparatus for reflecting heat generated by a space heater, for example a patio space heater fitted with a conventional circular heat reflector (i.e. the primary heat reflector) that is positioned above the heat source and providing an approximately parabolic reflector with its focus directed towards the ground. Such a reflector provides dispersal of some of the heat provided by the heat source (e.g. from electrical resistance or burning fuel) in a symmetrical, circular pattern that surrounds the space heater. Adjustable reflectors of the inventive concept are configured to attach to an existing space heater, and can be stored on such a heater in a compact, folded configuration when not in use. When in use, an adjustable reflector of the inventive concept can be unfolded and positioned within the existing circular reflector. Unfolding the adjustable reflector deploys two or more heat reflecting panels, which can be held at varying angles relative to a heat source of the space heater to direct heat generated by the space heater at varying angles relative to vertical. Similarly, the two or more heat reflecting panels can be oriented and held at varying angles relative to each other to provide adjustment of the position and size of an asymmetrical heated area (for example, to provide heating to an occupied area on one side of a space heater). This adjustability permits a user to control both the direction and the distribution of heat produced by the space heater and, in reflecting heat that could otherwise be wasted in heating an unoccupied area, reduce energy costs associated with operation of such a space heater. Conversely, in situations where the occupied area surrounds a space heater so equipped, the heat reflector can be folded and pivoted into the parabolic reflector to permit the heater to distribute heat conventionally in a radially symmetrical fashion.

One should appreciate that the disclosed devices and methods provide many advantageous technical effects including reduced fuel consumption by a space heater utilizing the adjustable reflector and protection of objects positioned behind the adjustable reflector from heat produced by the space heater while also directing heat downwards and towards occupants of the area to be heated. It should also be appreciated that the reflector can be folded and positioned within the space heater so as to permit conventional operation without the need for removal of the heat reflector.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously. As used in the description herein and throughout the claims that follow, the meaning of "a," "an," and "the" includes plural reference unless the context clearly dictates otherwise. Also, as used in the description herein, the meaning of "in" inchides "in" and "on" unless the context clearly dictates otherwise.

Within this application a space heater is generally recognized as a device for producing heat and/or infrared radiation and distributing it within an outdoor setting. An example of a typical space heater is an "umbrella" style patio heater, which includes a stabilizing base that supports a central shaft that extends vertically. Towards the top of the vertical shaft is positioned a heating element, which is typically a propane or natural gas burner or an electrically resistive element. Positioned above the heating element is typically an approximately parabolic reflector, oriented approximately parallel to the ground and with its concave surface oriented downwards, such that the focus lies along the axis defined by the central shaft. Such a space heater generates a 360° distribution of heat, however in many (if not most) instances users are congregated within only a portion of the heated area—with heat directed to unoccupied areas being wasted. Similarly, the heating effect generated by such space heaters diminishes rapidly with distance from the central shaft. As such, it can be necessary to restrict outdoor activities to positions near the space heater, utilize two or more space heaters, and/or to move single space heater between different desired locations.

The parabolic reflector of a typical space heater is configured to, essentially, direct heat downwards, with elevation providing definition of the heated area. Adjustable heat reflectors of the inventive concept attach to such space heaters, and serve to direct the heat produced laterally relative to the central Shaft, with an angular distribution of less than 180°, and to provide angular adjustment of the projected heat relative to the vertical axis. Examples of adjustable heat reflectors of the inventive concept are shown in FIG. 1 and FIG. 2.

FIG. 2: An alternative embodiment of an adjustable heat reflector of the inventive concept.

As shown in FIG. 1 and FIG. 2, adjustable heat reflectors of the inventive concept can include two or more heat reflective panels (140A, 140B, 240A, 240B). In some embodiments, heat reflector panels are coupled to a support structure, such as a central support 110 or a central heat reflecting panel 225. As shown in FIG. 2, in some embodiments a central heat reflecting panel 225 can be coupled to as central support 210. Couple of heat reflecting panels to as support structure can be provided by hinge mechanisms (130A, 130B, 230A, 230B). As shown in FIG. 2, in some embodiments a central heat reflecting panel 225 can be coupled to a central support 210. A suitable hinge mechanism can be any mechanism that permits deflection of a heat reflector panel from the support structure without the use of tools, and that can maintain the angular position of the heat reflective panel from the support structure when the deflecting force is discontinued. Hinge mechanisms can permit deflection of a heat reflecting panel from 0° to 180° or more relative to the corresponding support structure. In a preferred embodiment, the support structure is a central heat reflecting panel, and the hinge mechanism permits the heat reflecting panels to be folded over the central heat reflecting panel for compact and unobtrusive storage when the adjustable heat reflector is not in use. Suitable hinge mechanisms include multiple individual hinges, piano hinges, creases or similar regions of decreased stiffness within a continuous sheet of heat reflective material, inserts of deformable material, and so on. Such hinge mechanisms can include devices that provide resistance to movement of the hinge, so as to permit a user to adjust a heat reflecting panel to a desired position and have it remain in that position during use. For example, if a piano hinge is utilized it can include a central pin that is threaded over at least a portion of its length that protrudes from the hinge mechanism. Such a protruding segment can be fitted with a sleeve or nut having a complementary thread, and which can be rotated to apply tension to the piano hinge and increase its resistance to movement.

In some embodiments of the inventive concept, at least one edge of the heat reflective panel is curvilinear, and approximates the curvature of the concave inner surface of the parabolic reflector of the space heater. In other embodiments all edges of the heat reflective panel(s) is(are) straight. In a preferred embodiment, the adjustable heat reflector is configured so that, once mounted, a gap of between about 5 mm and about 25 mm is present between the inner surface of the parabolic reflector and the closest edge of a mounted adjustable heat reflector. In embodiments incorporating a curvilinear edge, the curvature of the edge of the heat reflective panel and this gap facilitate adjustment of the angle of a heat reflective panel relative to its corresponding support structure when the adjustable heat reflector is mounted.

A mount (110, 210) can be coupled to the support structure, and provides a point of attachment to the parabolic reflector of the space heater and a pivoting mechanism that permits adjustment of the angle of the support structure (and hence the heat reflecting panels of the device) from about vertical (e.g. parallel to the central shaft of the space heater) to about horizontal (e.g. contacting the concave surface of the parabolic reflector of the space heater). Such a mount can include an upper portion that couples to the concave surface of the parabolic reflector of the space heater. In preferred embodiments this portion of the mount couples to the parabolic reflector using an existing opening (for example, an existing aperture provided in the parabolic reflector for attachment to the space heater). Such a mount can also include a lower portion that is coupled to a central support of a heat reflector of the inventive concept. Such upper and lower portions can be coupled by a pivoting mechanism that permits adjustment of the angle defined by the upper and lower portions of the mount, and hence adjustment of the angle between the vertical axis and a heat reflector of the inventive concept. Such a pivoting mechanism can include a tensioning mechanism that adjusts resistance to rotation, permitting the angle of a heat reflector of the inventive concept relative to the vertical axis to be adjusted manually (i.e. without removal, and/or without the use of tools), and in some embodiments to maintain such an angle without additional support. For example, a pivoting mechanism can be provided by through-holes between the upper and lower portions of the mount that are aligned along a shaft that includes a tensioning mechanism. Such a shaft can, for example, includes threads and a complementary bolt that can be rotated to reduce the effective length of the shaft and supply a force that resists rotation of the pivot. In a preferred embodiment, tensioning of the tensioning device can impart a curve to a portion of the heater coupling portion that is located proximal to the interior or concave surface of a space heater parabolic reflector, such that the curve of the heater coupling portion at least approximates the curve of the interior of concave surface thereby facilitating movement of the adjustable heat reflector.

A mount utilized in an adjustable heat reflector of the inventive concept can be configured to couple to an edge of an interior or concave surface of a parabolic heat reflector of a space heater, for example a clip, a clamp, or a pivoting hinge mechanism. In a preferred embodiment, the mount is coupled to such a parabolic heat reflector via an existing opening, for example a hole normally utilized for a screw or bolt and located proximal to a heating element of the space heater. As noted above, such a mount permits adjustment of the angle of a heat reflector of the inventive concept relative to the vertical axis.

Figure 3:
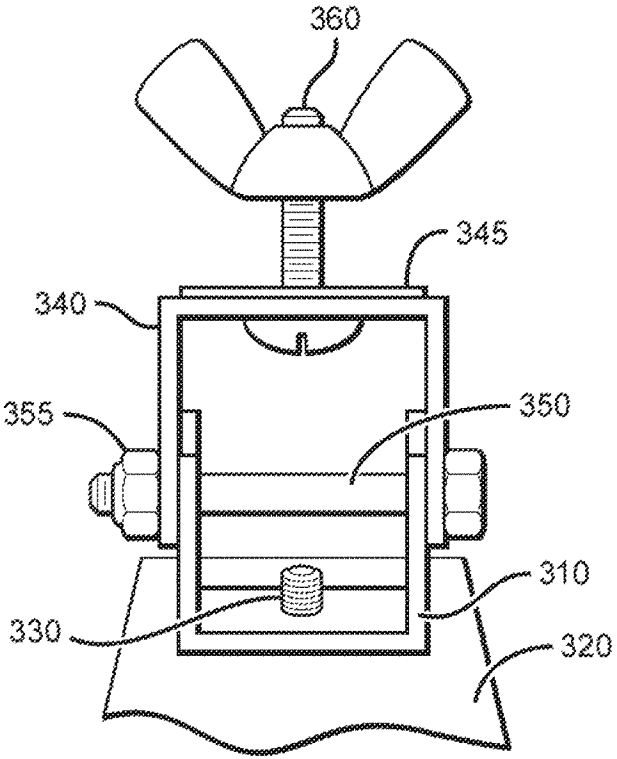
FIG. 3 depicts a mount that is used to attach a heat reflector of the inventive concept to a space heater.

An example of a mount of the inventive concept is shown in FIG. 3. FIG. 3 depicts a mount with a lower portion 310 that is coupled to a central support 320 of a heat reflector of the inventive concept. Although this coupling is depicted as being performed using a sheet metal screw 330, it should be appreciated that this can also be accomplished using other suitable methods and devices, including the use of a bolt, rivet, and/or clamp, the use of an adhesive, welding, and so on. Alternatively, the lower portion of the mount can be formed as part of a central support during the manufacturing process, for example by molding or 3 dimensional printing. As Shown, the lower portion 310 is joined to an upper portion 340 by a pivoting mechanism that provides angular displacement between the upper and lower portions of the mount. The upper portion 340 has an upper face 345 that can contact the inner, concave surface of the parabolic reflector of the space heater when a heat reflector of the inventive concept is installed. As shown, this upper surface 345 can support a fixing device 360 that is dimensioned to fit through an existing opening in a parabolic reflector of a space heater. Although shown as a bolt equipped with a wing nut, it should be appreciated that the fixing device 360 can be any suitable attaching device, for example a screw, a clamp, a clip, and/or an expanding bolt. Upper and lower portions of the mount can be made of any suitable heat resistant material, for example steel, aluminum, cast iron, etc. In some embodiments the upper and lower portions of the mount are made of the same material. In other embodiments the upper and lower portions of the mount can be made of different materials. For example, the upper portion of a mount of the inventive concept can be constructed of a material that provides a greater degree of flexion and/or deformation under stress than that of the lower portion of the mount.

As shown, a tensioning device 350 transits across the upper portion 340 of the mount. Such a tensioning device can apply tension across the upper portion 340 of the mount so as to increase resistance to angular movement between the upper portion 340 and the lower portion 410 of the mount. As shown, this can be accomplished by providing a nut 355 with threading that is complementary to that provided on the tensioning device 350. Alternatively, such threading can be provided in a through hole of the upper portion 340 through which at least a portion of the tensioning device 350 passes. It should be appreciated that other methods and device can be utilized to apply transverse pressure across the upper portion 340 of the mount, for example a clamp. In some embodiments the material of the upper portion 340 can be selected so that tension applied by the tensioning device 350 imparts a curve to the upper surface 345. In a preferred embodiment this material is selected so that the curve so generated reflects the curve of inner, concave surface of the parabolic reflector of the space heater, thereby improving contact between the heat reflector and the space heater and providing a secure and fixed (e.g. non-rotating) attachment. In some embodiments of the inventive concept the interface between the upper and lower portions can permit adjustment to any angle desired by the user. In other embodiments the interface between the upper and lower portions of the mount can include stops and/or complementary projections and indentations that guide the user to one or more preferred angles of deflection between the upper and lower portions of the mount.

Figure 4B:
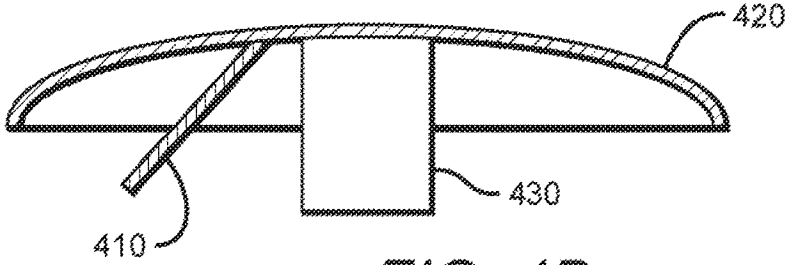
Figure 4C:
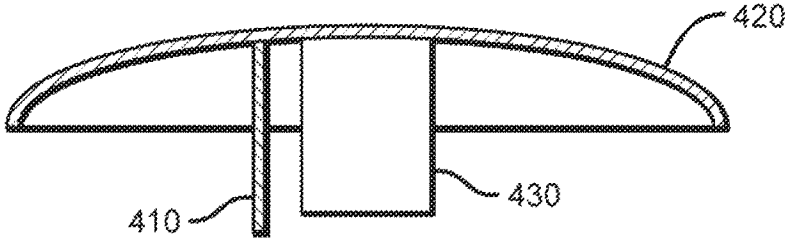

As noted above, such a mount provides convenient and stable adjustment of the angle of a heat reflector of the inventive concept relative to the vertical axis. Examples of this angular adjustment can be seen in FIG. 4A, FIG. 4B, and FIG. 4C. FIG. 4A depicts a heat reflector of the inventive concept 410 mounted within a parabolic reflector 420 of a space heater in a nearly horizontal position relative to the heating element 430. In such a position reflection of heat at an angle to the vertical axis is minimal and the output of the space heater will resemble that of a space heater that does not include a heat reflector of the inventive concept. Such a position can, for example, be used when the area to be heated is distributed radially around the space heater. It should be appreciated that removal and/or disassembly of the heat reflector 310 is not necessary to achieve this result. FIG. 4B shows the heat reflector 410 tilted to an approximately 45° angle relative to the heating element 430. In this position heat is directed downwards and laterally, directing heat downwards and to one side of the space heater. It should be appreciated that less heat is provided by the heating element 430 to an area on the opposing side of the heat reflector, which is presumably unoccupied when the heat reflector 410 is in such a position. FIG. 4C shows the heat reflector 410 positioned essentially vertically (i.e. parallel to the heating element 430). In such a position heat emitted from the heating element 430 is reflected to one side of the space heater, leaving the remaining side essentially unheated. In some embodiments of the inventive concept the mount can be configured to provide a user with a selection of pre-determined angles of deflection of the heat reflector from the vertical axis. In other embodiments of the inventive concept the mount can provide a user with the ability to select any suitable angle of deflection from the vertical axis for the heat reflector.

As noted above, and as depicted in FIG. 5A, FIG. 5B, and FIG. 5C, in some embodiments of the inventive concept heat reflective panels of the adjustable heat reflector can be pivoted relative to each other and/or to a central heat reflective panel in order to permit a user to adjust the angular distribution of heat produced be a space heater. Towards that end a hinge utilized with a heat reflective panel can include a mechanism that stabilizes the heat reflective panel at the desired position. Suitable stabilizing mechanisms include clips, clamps, ratcheting devices, and tensioning mechanisms. In a preferred embodiment of the inventive concept a tensioning mechanism is provided with the hinge that applies force along a the axis of rotation of the hinge, such that application of tension increases the force necessary to deflect the hinge. For example if a piano hinge is utilized all or part of the central pin can include a threaded region, such that application of a nut to an exposed portion of such a threaded region applies tension to the hinge along the rotational axis.

Figure 5A:
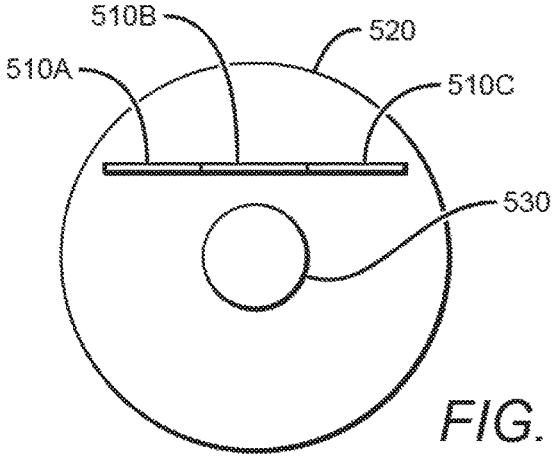
FIGS. 5A, 5B, and 5C depict different positions for lateral heat reflecting panels of a heat reflector of the inventive concept.
Figure 5B:
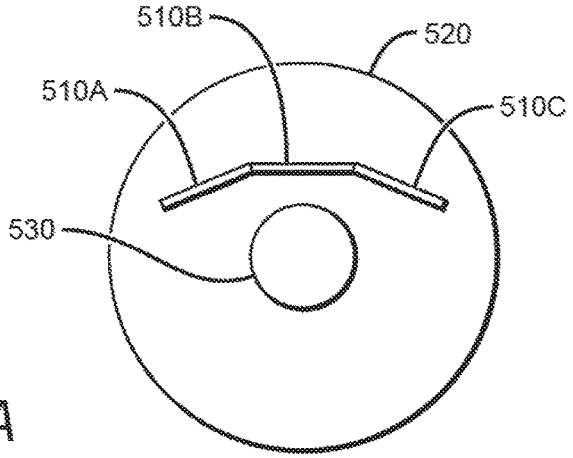
Figure 5C:
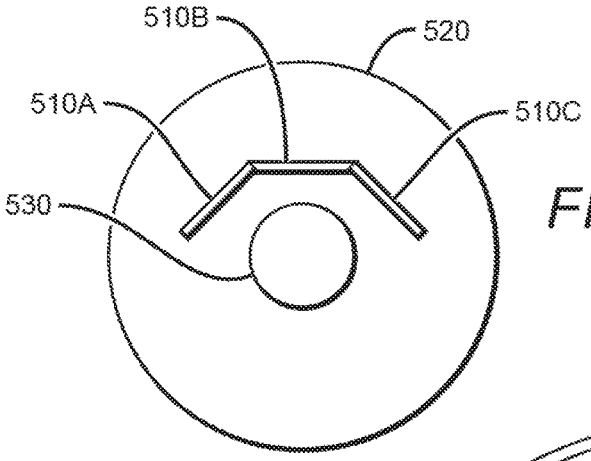

As shown in FIG. 5A, (which shows a top-down view of a heat reflector of the inventive concept within a parabolic reflector 520 of a space heater) side heat reflecting panels 510A and 510C can be arranged in an essentially linear fashion relative to the central heat reflecting panel 510B. This redirects heat emitted by the heating element 530 over an area that is substantially less (e.g. about 50% less) than that of an unmodified space heater. FIG. 5B depicts an arrangement in which side heat reflecting panels 510A and 510C are arranged at slight (in this instance about 15°) angles relative to the central heat reflecting panel 510B. This provides a further reduced heated area and further concentration of heat provided by the heating element 530. Similarly, FIG. 5C depicts an arrangement in which the side heat reflecting panels 510A and 510C are arranged at a more pronounced angle (e.g. about 45°) relative to the central heat reflecting panel 510B. This provides a substantially reduced (i.e. less than about 30% of that of an unmodified space heater) heated area. Such reduced heated areas permit the heating element 530 to be operated at reduced energy consumption while providing adequate heating to a partially occupied area proximal to the space heater. Although FIGS. 5A to 5C depict the side heat reflecting panels 510A, 510C as arranged symmetrically relative to a central heat reflecting panel 510B, it should be appreciated that in some embodiments such side heat reflecting panels can be positioned at dissimilar angles so as to provide an asymmetrically heated area. This advantageously provides adjustment of a heated area to conform to a wide range of potential seating or use arrangements.

Figure 6:
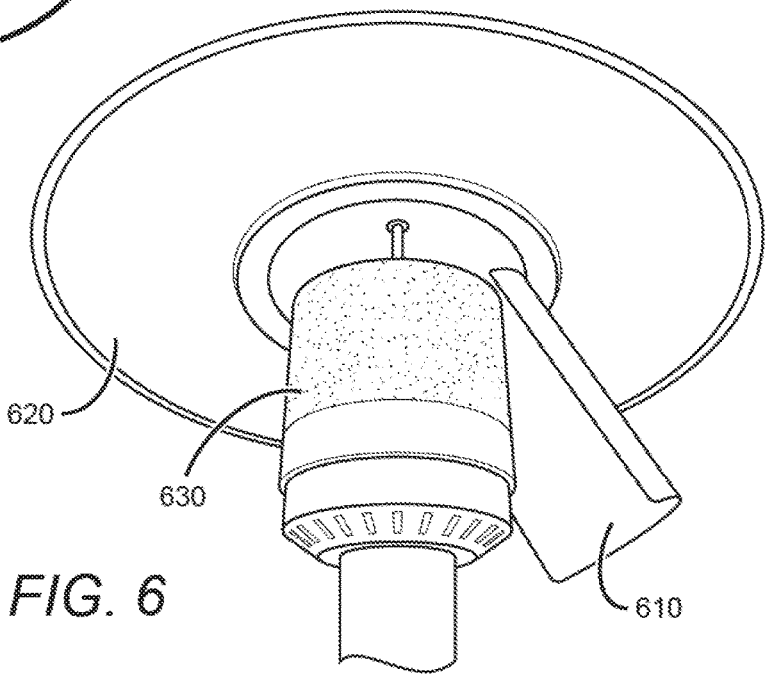
FIG. 6 depicts a curved heat reflector of the inventive concept.

Another embodiments of the inventive concept is a adjustable heat reflector that includes a curved heat reflecting panel with a central mount. As described above, the mount can include a pivoting or rotating mechanism interposed between the portion of the mount that is affixed to the space heater and the portion of the mount that is affixed to the curved heat reflecting panel. This arrangement permits a curved heat reflecting panel to be pivoted vertically relative to the space heater. An example of such an embodiment is shown in FIG. 6, shown mounted within the reflector of an umbrella-style space heater. As shown in FIG. 6, in such an embodiment a curved heat reflector 610 can be affixed along an edge to the inner, concave surface of a parabolic reflector 620 of a space heater. Use of a pivoting mount, as described above, permits adjustment of the angle of the curved heat reflector 610 relative to the vertical axis, reflecting and redistributing heat provided by a heating element 630 downwards and over a restricted area relative to that of an unmodified space heater. In a preferred embodiment the curvature of such a curved heat reflector is similar (e.g. within 20%, 15%, 10%, 5%, or less than 5%) of the curvature of the heating element of the space heater, however describing a greater radius than that of the heating element.

In some embodiments of the inventive concept such a curved heat reflector can include a single, fixed and curved heat reflecting panel. In other embodiments, a curved heat reflector can include a central curved heat reflecting panel and one or more sliding heat reflecting panels that can slide out and extend laterally from the central curved heat reflecting panel. Such an embodiment is depicted in FIG. 7A, which depicts the rear (i.e. not facing a heating element on installation in a space heater) surface of such an embodiment. As shown in FIG. 7A such a heat reflector includes a central curved heat reflecting panel 710, which in turn includes a mount 720, supports lateral curved heating panels 730A, 730B. The lateral curved heat reflecting panels have edges that are engaged with a sliding mechanism that permits them to extend over and move along the central curved heat reflecting panel. Such sliding heat reflecting panels can have a curvature that is similar or identical to that of the central curved panel, such that the arc described by the central curved heat reflecting panel continues on extension of the sliding heat reflecting panels. Such lateral curved heat reflecting panels can be supported along and/or engaged with one or more channels that are affixed to or incorporated into the central curved heat reflecting panel along one or more edges. Such channels can be continuous or discontinuous (for example, a series of brackets or similar supports). Alternatively, such lateral curved heat reflecting panels can be engaged with one or more rails that are affixed to or incorporated into the central curved heat reflecting panel. Such a rail or rails can be positioned at or near an edge of the central curved heat reflecting panel or, alternatively, at or near a center line. In some embodiments of the inventive concept, such lateral curved heat reflecting panels can be engaged with both one or more rails and one or more channels affixed to and/or incorporated into the central curved heat reflecting panel. FIG. 7B depicts a view of a front (i.e. facing a heating element of a space heater when installed) face of such a heat reflector with the lateral curved heat reflecting panels 730A, 730B partially extended. FIG. 7C depicts a view of the rear face of such a heat reflector installed in a space heater. As shown in FIG. 7C, a central curved heat reflector 710 is affixed to the interior concave surface of the parabolic reflector 740 of the space heater. The lateral curved heat reflectors 730A, 730B are shown extended, and the heat reflector is positioned at an angle relative to the vertical axis. In such a position the heat reflector redirects heat provided by the heating element 750 over a reduced area, advantageously reducing energy consumption by the space heater when it is desired to heat only a portion of the area surrounding it.

It should be appreciated that an adjustable heat reflector of the inventive concept, therefore, permits a user to control both the vertical and horizontal angular distribution of heat produced by a space heater, via pivoting of both the coupling mechanism relative to a parabolic reflector of the space heater and the heat reflective panels relative to each other, respectively.

Materials utilized in the construction of an adjustable heat reflector of the inventive concept can be any suitably heat resistant and heat reflective material. Suitable materials include steel, stainless steel, aluminum, brass, copper, tin, and combinations thereof. It should be appreciated that although depicted in this application has being essentially planar, one or more of the heat reflecting panels and/or a central heat reflecting panel of the adjustable heat reflector can be curved (i.e. as in an arc or parabola). Thickness of the materials utilized in construction of the adjustable heat reflector can vary depending on their intended use. For example, materials utilized in weight-bearing portions of the mount can range from about 1 mm to about 5 mm in thickness whereas materials utilized for purposes of heat reflection can range from about 0.5 mm to about 3 mm in thickness.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

It should be apparent to those skilled in the art that many more modifications besides those already described are possible without departing from the inventive concepts herein. The inventive subject matter, therefore, is not to be restricted except in the spirit, of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. An adjustable supplementary heat reflector comprising:

a central support comprising a first edge, and a second edge opposing the first edge, and a mount comprising a pivot, wherein the mount is configured to couple to a primary curved heat reflector of a space heater and to provide movement, at the pivot, of the central support along a first axis of rotation relative to a major axis of the space heater, and wherein the primary curved heat reflector is between 0.5 mm to 5 mm in thickness;

a first lateral curved heat reflecting panel and a second lateral curved heat reflecting panel slidably coupled to the primary curved heat reflector, wherein the first lateral curved heat reflecting panel and the second lateral curved heat reflecting panel at least partially overlap with the primary curved heat reflecting panel, wherein the first lateral curved heat reflecting panel and the second lateral curved heat reflecting panel are configured to slide laterally relative to the primary curved heat reflector, wherein the first lateral curved heat reflecting panel and the second lateral curved heat reflecting panel are each 0.5 mm to 5 mm in thickness, wherein the mount comprises a stepped adjustment mechanism, wherein the stepped adjustment mechanism provides the user with a selection of predetermined angles of deflection from the vertical axis, and wherein the primary curved heat reflector, the first lateral curved heat reflecting panel, and the second lateral curved heat reflecting panel are rectangular and have substantially identical and substantially constant radii of curvature relative to the major axis of the space heater.

2. The adjustable supplementary heat reflector of claim 1, wherein the central support further comprises a central heat reflector, and wherein the first pivoting mechanism and the second pivoting mechanism are coupled to opposing edges of the central heat reflector.

3. The adjustable supplementary heat reflector of claim 1, wherein the first pivoting mechanism comprises a second tensioning mechanism configured to apply a second tensioning force to the first pivoting mechanism so as to resist rotation through the second axis of rotation.

4. The adjustable supplementary heat reflector of claim 1, wherein at least one of the first pivoting mechanism and the second pivoting mechanism comprises a hinge.

5. The adjustable supplementary heat reflector of claim 4, wherein the first pivoting mechanism comprises a first pin and the second pivoting mechanism comprises a second pin, and wherein at least a portion of the first pin and the second pin are threaded.

6. The adjustable supplementary heat reflector of claim 5, further comprising a first tensioning cap having a threading complementary to that of the first pin and a second tensioning cap having a threading complementary to that of the second pin.

* * * * *